US006419616B1

(12) United States Patent
Campbell

(10) Patent No.: US 6,419,616 B1
(45) Date of Patent: Jul. 16, 2002

(54) LABEL LOOPER

(75) Inventor: Donald A. Campbell, Binghamton, NY (US)

(73) Assignee: Paxar Corporation, White Plains, NY (US)

( * ) Notice: Subject to any disclaimer, the term of this patent is extended or adjusted under 35 U.S.C. 154(b) by 108 days.

(21) Appl. No.: 09/145,399

(22) Filed: Sep. 1, 1998

(51) Int. Cl.[7] ..... B31B 1/20

(52) U.S. Cl. ..... 493/23; 493/10; 493/24; 493/25; 493/254; 493/397; 493/427; 493/434; 493/442; 53/531

(58) Field of Search ..... 53/531; 493/3, 493/8, 23, 10, 24, 25, 243, 254, 397, 405, 434, 427, 442

(56) References Cited

U.S. PATENT DOCUMENTS

| | | | | |
|---|---|---|---|---|
| 2,516,454 A | * | 7/1950 | Doran | 270/80 |
| 2,834,595 A | * | 5/1958 | Gilchrist | 270/81 |
| 3,106,809 A | | 10/1963 | Forthmann, Jr. | 226/115 |
| 3,712,610 A | * | 1/1973 | Garrone | 270/79 |
| 3,776,441 A | | 12/1973 | Forthmann, Jr. et al. | 53/520 |
| 3,918,698 A | * | 11/1975 | Coast | 270/69 |
| 3,947,310 A | * | 3/1976 | Parker | 156/289 |
| 4,221,373 A | * | 9/1980 | Muller Hans | 270/86 |
| 4,232,592 A | * | 11/1980 | Gingerich | 493/10 |
| 5,871,433 A | * | 2/1999 | Lehmann et al. | 493/420 |

OTHER PUBLICATIONS

PAXAR 8500 Loop Fold Attachment, Operation/Maintenance Parts List, Feb. 1995.

* cited by examiner

*Primary Examiner*—Allen Ostrager
*Assistant Examiner*—William Hong
(74) *Attorney, Agent, or Firm*—Joseph J. Grass

(57) ABSTRACT

There is disclosed a method and apparatus for making a looped label and accumulating labels in a stack. An intermediate portion of the label is inserted into the nip of a pair of rotating rolls which fold or loop the label into two side-by-side or face-to-face label portions. The looped label is transported between the nip of a pair of pressing rolls which press or iron the label at the fold line while the label is stationary between the rolls to maintain the label in the folded condition. From there the label is passed into a stacker in which successively looped labels are stacked.

24 Claims, 11 Drawing Sheets

LABEL LOOPER

BACKGROUND OF THE INVENTION

This invention relates to the art of label loopers and label looping methods.

BACKGROUND OF THE INVENTION

Field of the Invention

BRIEF DESCRIPTION OF THE PRIOR ART

The following prior art is made of record: U.S. Pat. No. 3,106,809 to Forthman, Jr., U.S. Pat. No. 3,776,411 to Forthman, Jr. et al, and PAXAR 8500 Loop Fold Attachment, Operation/Maintenance and Parts List, February 1995.

SUMMARY OF THE INVENTION

This invention relates to improved method and apparatus for making a looped label and accumulating successive labels in a stack.

It is a feature of the invention to provide a label looper having a high capacity for looping labels and in particular to a looper which has a higher capacity than a parent device such as a printer which prints labels arranged in a web and cuts individual labels from the web. In this way the capacity of the parent device is not restricted by the looper.

It is a feature of the invention to provide an improved looper which uses a pair of rotating rolls and wherein a portion of the label is inserted into the nip of the rolls to fold or loop the label into a looped label.

It is another feature of the invention to use selectively rotatable pressing rolls to press or iron the looped label at the fold line to help maintain the looped label in its folded condition. At least one and preferably both of the pressing rolls are driven to bring the folded leading end of the looped label into the nip of the pressing rolls. When the looped label is thus in the nip, the rolls preferably do not rotate. In that at least one of the pressing rolls is heated, and the rolls cause the portion of the looped label at and adjacent to the fold line to be pressed or ironed, to help maintain the looped label in its looped condition. After the label has been pressed for a predetermined period of time, pressing rolls rotate to advance the pressed folded label into a stacker.

It is a feature of the invention to provide a self-contained looper that loops and stacks, which takes the straight label from the parent device, such as a printer, and advances it to a predetermined position. When the leading end of the label reaches that predetermined position, an inserter folds the label at a predetermined intermediate location between its ends and inserts it into the nip of a pair of rotating rolls which help further fold the label. The label is transported to between a pair of pressing rolls which press the fold into the label. After this pressing action is complete, the pressing rolls rotate to advance the pressed looped label into a stacker.

Other features of the invention will be readily apparent to those skilled in the art from the following detailed description and the accompanying drawings.

DETAILED DESCRIPTION OF THE PREFERRED EMBODIMENT

Figure 1:
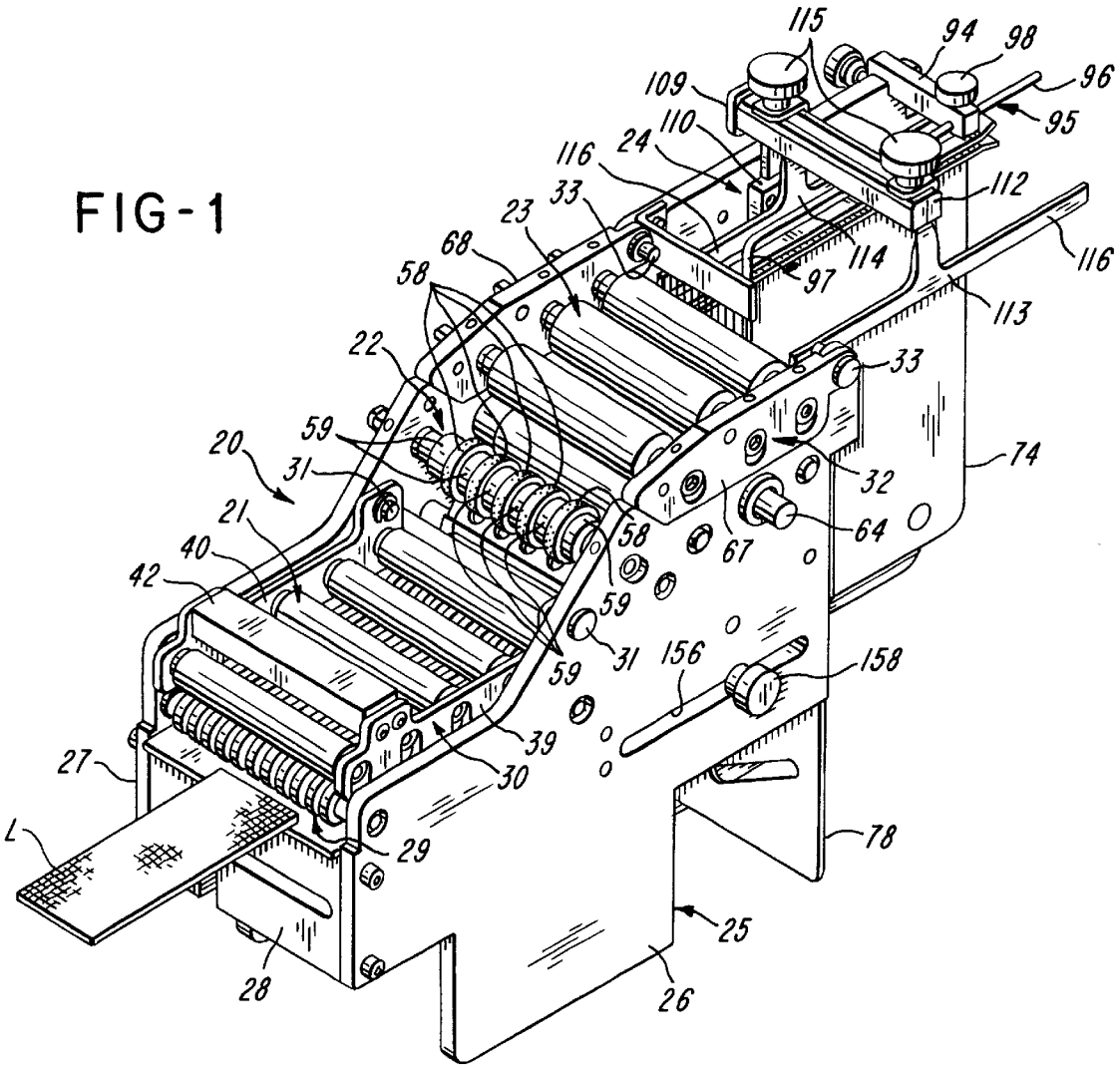
FIG. 1 is a perspective view of a looper in accordance with the invention.

With reference initially to FIG. 1, there is shown a looper generally indicated at 20 for looping and stacking labels L. The labels L are received from any suitable parent device such as a printer (not shown) which prints and cuts the labels L from a web of labels. Alternatively, the parent device can simply be a cutting mechanism that cuts labels from a previously printed web. The incoming label L, which is usually comprised of a fabric material, is essentially flat. The incoming label L is advanced by a conveying station generally indicated at 21 to a looping station 22. From there the looped label L is conveyed to a pressing station 23 where the looped label L dwells for a predetermined length of time after which the pressed looped label L is conveyed to a stacking station 24.

The looper 20 includes a frame generally indicated at 25 including a pair of generally parallel side plates 26 and 27 and transverse or lateral plates, one of which is indicated at 28. The conveying station 21 has a belt conveyor generally indicated at 29 (FIG. 2) above which is a roller assembly generally indicated at 30. The roller assembly 30 is pivotally mounted for upward swinging or pivotal movement on pivots 31 for easy access to the conveyor 29 and any label(s) L thereon. Similarly, the pressing station 23 has a roller assembly generally indicated at 32. The roller assembly 32 is pivotally mounted for upward swinging or pivotal movement on pivots 33 for easy access to certain other parts of the looper 20 and to any label(s) L below the roller assembly 32. The roller assembly 30 is releasably latched in the position shown.

Figure 2:
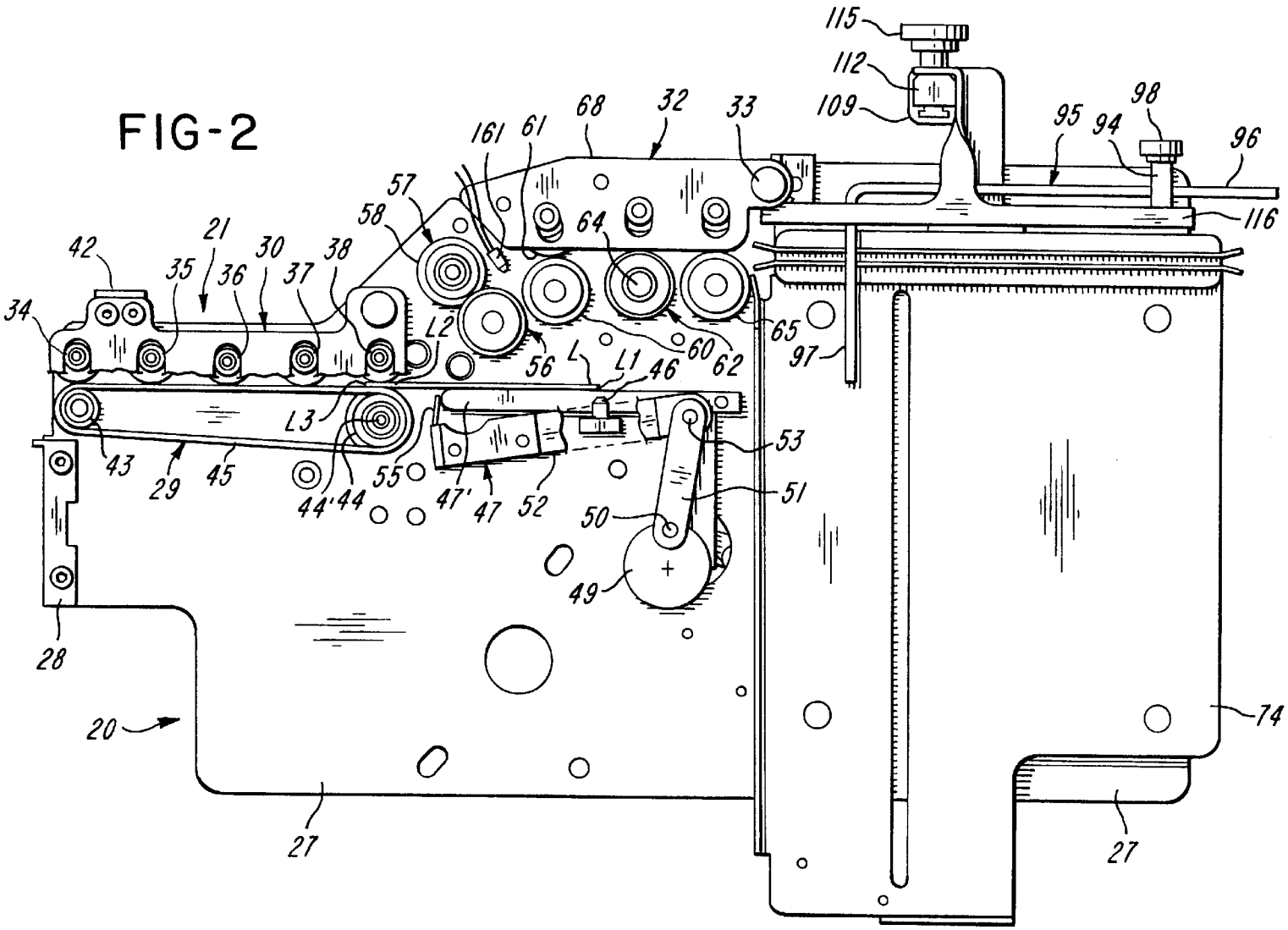
FIG. 2 is a longitudinal vertical sectional view through the looper, in its initial or home position.

With reference also to FIG. 2, the roller assembly 30 is shown to include five transversely extending spaced rollers 34 through 38 floatingly mounted for generally vertical movement in side plates 39 and 40. The side plates 39 and 40 are connected by a transverse bar 42. The conveyor 29 has a pair of grooved rollers 43 and 44. Laterally spaced belts 45 under tension are trained about the rollers 43 and 44.

FIG. 2 shows a label L as having been advanced to a position where its leading edge L1 is sensed by an optical sensor 46. It should be noted that the trailing marginal end portion L2 of the label L is still captive between the belts 45 and their associated wheel 44 below the label L and the roller 38 above the label L. An inserter generally indicated at 47 is shown in its down or home position in FIG. 2 out of the path of the label L. Also, the label L is supported beyond its trailing marginal end portion L2 on a table 47'. As soon as the sensor 46 senses the leading end L1, its signals the microprocessor 200 which cause the inserter 47 to move from the position shown in FIG. 2 to the position shown in FIG. 3. The inserter 47 is actuated by a single-revolution clutch 48 (FIG. 9) which drives a crank 49 (FIG. 2) through one revolution. The crank 49 has a pin 50 pivotally connected to a link 51 which in turn is pivotally connected to an arm 52 by a pin 53. The arm 52 mounts a comb 54 with tines 55 as best shown in FIGS. 12 through 15.

Figure 3:
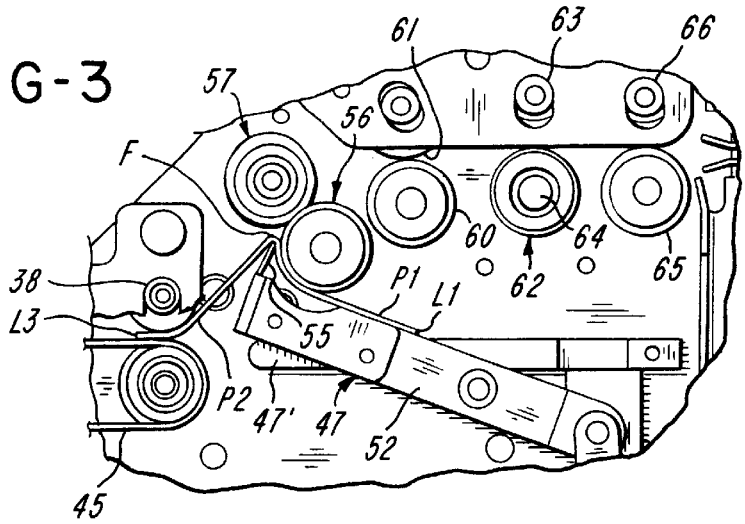
FIG. 3 is a fragmentary view of the looper as depicted in FIG. 2, but showing the inserter in its actuated position.
Figure 15:
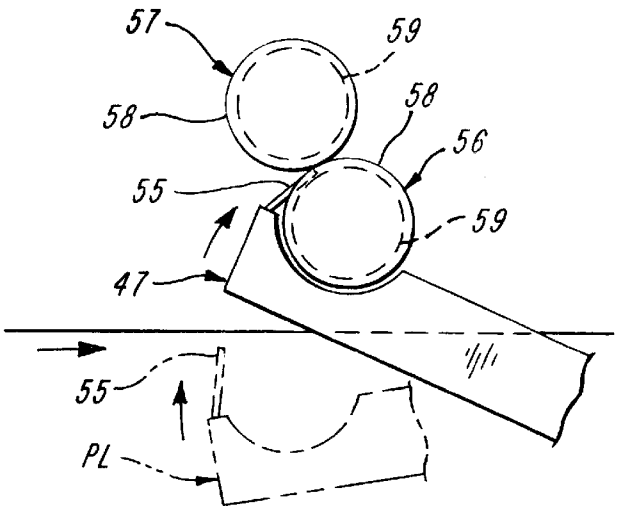
FIG. 15 is an elevational view taken from the right side of FIG. 14.
Figure 14:
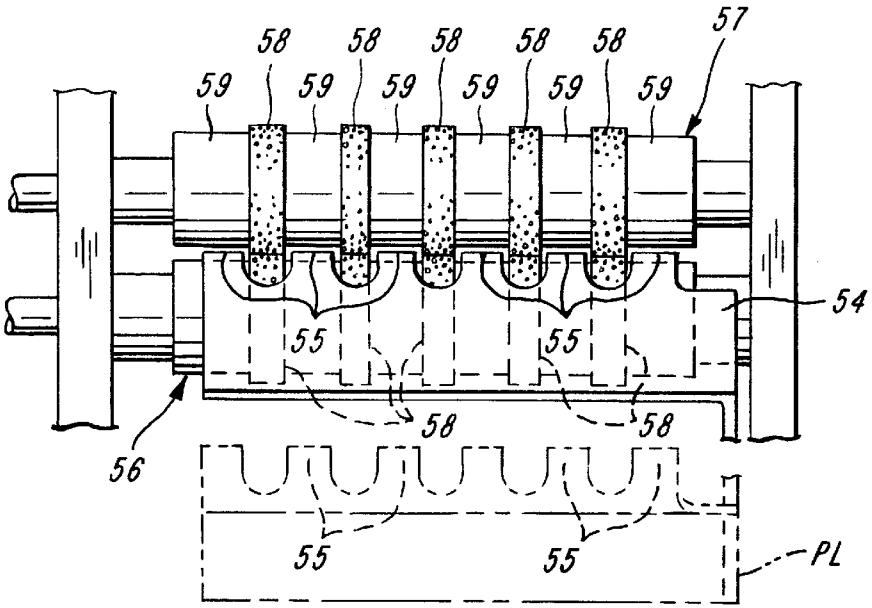
FIG. 14 is an elevational view of the two grooved rolls and the cooperating comb of the inserter in solid line and phantom line positions.

A pair of grooved rolls 56 and 57 having identical profiles, each have five grit surfaced ridges 58 and six grooves 59. The ridges 58 of the rolls 56 and 57 are aligned, and the ridges 58 of the roll 56 are in spring-urged contact with the ridges 58 on the roll 57. The grooves 59 on the rolls 56 and 57 are aligned. When the sensor 46 senses the leading end L1 of the label L, the single-revolution clutch 48 is operated to move the arm 52 and to cause the tines 55 to start to fold the label L at a predetermined place or transverse fold line F as shown in FIG. 3. The position of the fold line F is determined by the position of the leading end L1 when the tines 55 start to move upwardly. The position of the sensor 46 is horizontally adjustable to the right or left as viewed in FIG. 2 so that the stop position of the leading end L1 can be adjusted. The position of the leading end L1 determines the length of one portion P1 of the label L. The portion P1 extends from the leading end L1 to the fold line F. The remaining portion of the label L is indicated at P2. Because the trailing portion L2 is held in place at the conveyor station 21, as the arm 52 starts to pivot into the FIG. 3 position, the leading end L1 starts to regress. When the tines 55 have brought the label L to the FIG. 3 position, the tines 55 have brought the fold line F into the nip of the rolls 56 and 57 which then grip the label L at the fold line F and thus start to complete the folding or looping of the label L. The tines 55 can enter grooves 59 in the FIG. 3 position as best shown in FIGS. 14 and 15. As is apparent, the fold line F is at an intermediate location between the leading end L1 and the trailing end L3. The fold line F can be half way between the ends L1 and L3, in which case the portions P1 and P2 are of equal length. Alternately, depending on the length of the label L and the position of the sensor 46, the portions P1 and P2 can be of different lengths as is desired in certain applications. The expression "intermediate" location or position can be any selected location or portion between the terminal ends L1 and L3.

Figure 4:
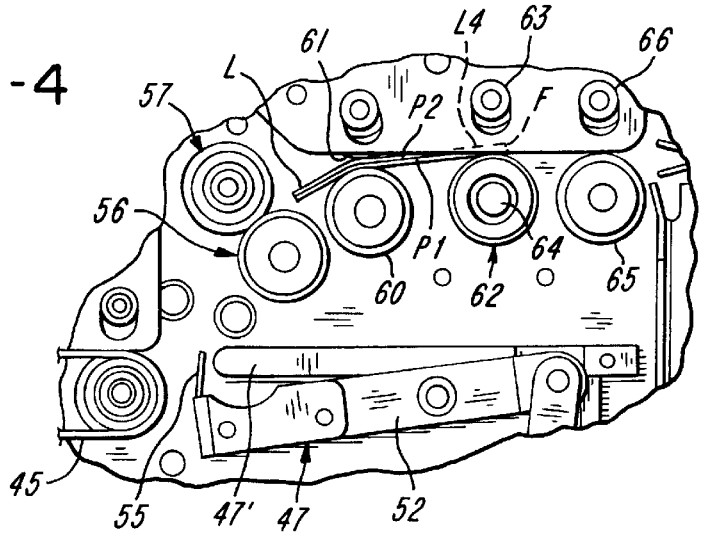
FIG. 4 is a view similar to FIG. 3, but showing the looped label in a position in which the looped or folded leading end of the label is entering the nip of the, pressing rolls.
Figure 5:
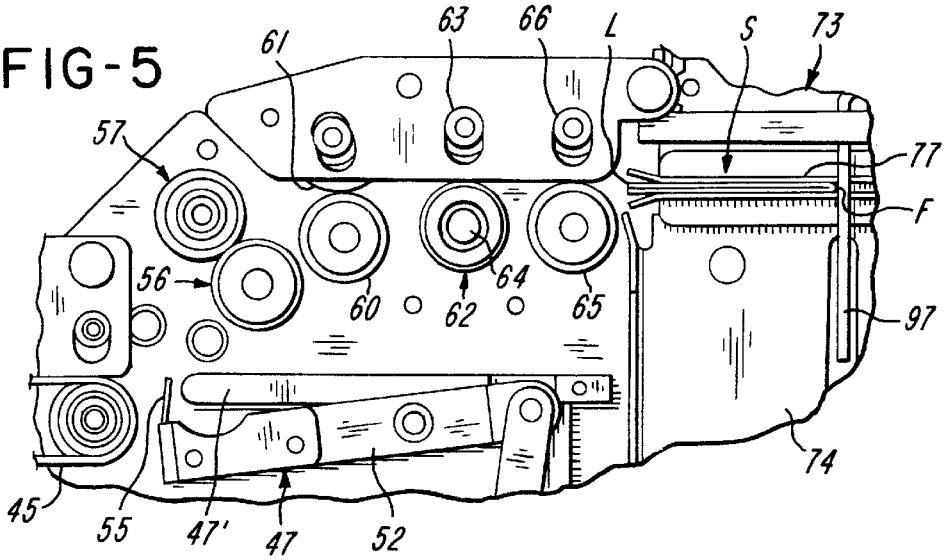
FIG. 5 is a view similar to FIG. 4, but showing the pressed looped label advanced to its position in the stacker.

As shown in FIG. 4, the rolls 56 and 57 and cooperating pairs of rolls 60 and 61 and 62 and 63 have advanced the looped label L in the forward feed direction to the pressing station 23. The portion of the label L at and closely adjacent to the fold line F is indicated at L4. The label portion L4 is shown to be between the rolls 62 and 63. The roll 62 is a hollow roll with a non-rotatable heater rod 64 received therein. The heater rod 64 heats the roll 62. When there is no label between the rolls 62 and 63, the rolls 62 and 63 are in contact, and the roll 63 is heated mainly by conduction. However, when portion L4 of a label L is between the rolls 62 and 63, the portion L4 is pressed or ironed to press or iron the fold F permanently into the label L. For effective pressing or ironing, the drive motion to the rolls 62 and 63 (and also to the rolls 56 and 57, and 60 and 61) is interrupted. The rolls 62 and 63 thus dwell or are stationary allowing the heat from the rolls 62 and 63 to iron or press the fold F. This pressing or ironing action is enhanced because the roll 63 is spring-urged downwardly toward the roll 62. Also, the roll 61 is spring-urged downwardly toward the roll 60, and a roll 66 is spring-urged downwardly against a roll 65. When the label L has dwelled at the pressing station 23 for the predetermined or preselected period of time, the sets of rolls 60 and 61, 62 and 63, and 65 and 66 are again rotated to advance the pressed looped label L to the stacking station 24 as shown in FIG. 5. The timing is set so that the conveyor 29 is driven whenever the sets of rolls 56 and 57, 60 and 61, 62 and 63, and 65 and 66 are driven. Therefore, while the rolls 65 and 66 are advancing a label L into the stacking station 24, the conveyor can transport the next label L to the FIG. 2 position.

Alternatively, the sets of rolls 56 and 57, 60 and 61, 62 and 63, and 65 and 55 can be stepped in the direction opposite to the feed direction described above by one or two steps, and thereafter advanced again in the feed direction to further iron or press the portion L4 of the label L.

Figure 8:
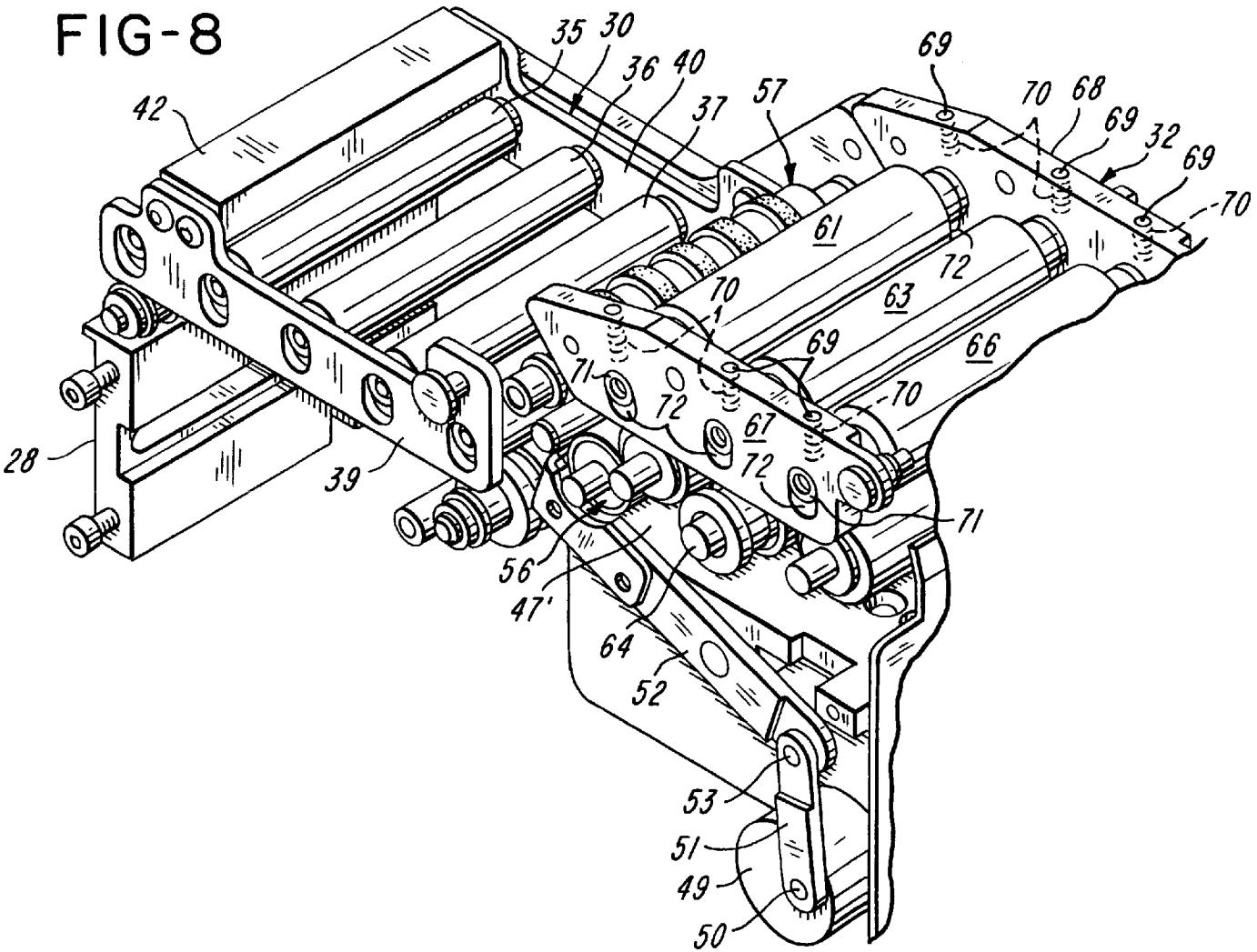
FIG. 8 is a fragmentary perspective view of the looper with one side plate removed.

With reference to FIG. 8, the roller assembly 32 is comprised of a pair of rigidly connected end plates 67 and 68 having set screws 69. The set screws 69 bear against springs 70 which in turn bear against bearings 71 for the rolls 57, 63 and 66. The forces on the bearings 71 are adjustable by turning the respective set screws 69. As shown, the bearings 71 are received in elongate slots 72 which allow movement of the rolls 57, 63 and 66 as the label L passes thereunder. The roller assembly 32 is releasably latched in the position shown.

Figure 7:
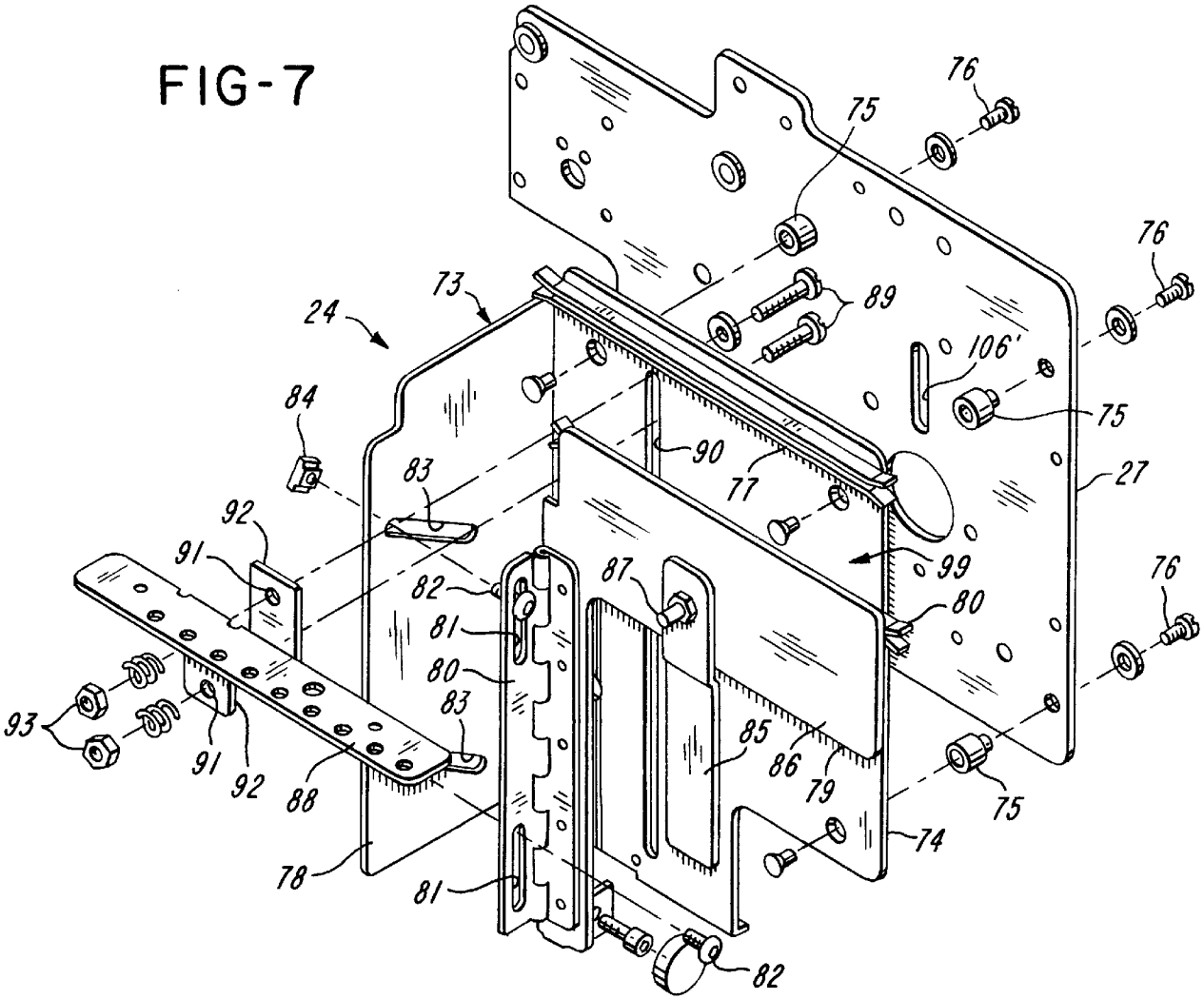
FIG. 7 is a perspective view showing additional portions of the stacker.

The stacking station 24 includes a stacker generally indicated at 73 in FIG. 7. The stacker 73 includes a side plate 74 spaced slightly from and secured to the side plate 27 by standoffs 75 and fasteners 76. A generally horizontal channel 77 is secured to the plate 74. The plate 74 is parallel to the side plate 27 and a front wall or plate 78 extends perpendicularly to the plate 74. A plate 79 is shown to be parallel to the plate 74 and has a channel 80 opposed to and coextensive in length with the channel 77. The plate 79 is L-shaped and has a vertically extending hinge 80 connecting the plates 78 and 79. The hinge 80 has elongate vertical slots 81 for receiving threaded fasteners 82 to allow for vertical adjustment of the plate 79 and its channel 80. The fasteners 82 pass through oblique slots 83 which allows the width of the space between plates 74 and 79 to be adjusted. The fasteners 82 are threadably received by identical nuts 84 (only one of which is shown). A depending plate 85 is secured to a horizontal leg 86 of the L-shaped plate 79. The plate 85 is held connected to the leg 86 by a screw 87. The plate 85 is spaced slightly from the leg 86 at the screw to accommodate a compression spring (not shown) encircling the screw 87. This enables the plate 85 to be swung out of the way into the horizontal position, thus providing greater access to the stack S by the user. Also the plate 79 together with the plate 85 which it mounts can be pivoted clockwise from the position shown in FIG. 7 to allow the user to easily remove the stack S from the stacker 73. Positioned between the plates 74 and 79 is a floor or platform 88 which supports the entire stack S of labels L. Screws 89 passing through a vertical elongate slot 90 in the plate 74 pass through holes 91 in a bracket 92 secured to the platform 88 and threadably receive nuts 93. The height of the platform 88 can be adjusted by loosening the nuts 93 moving the platform either up or down and re-tightening the nuts 93.

Figure 6:
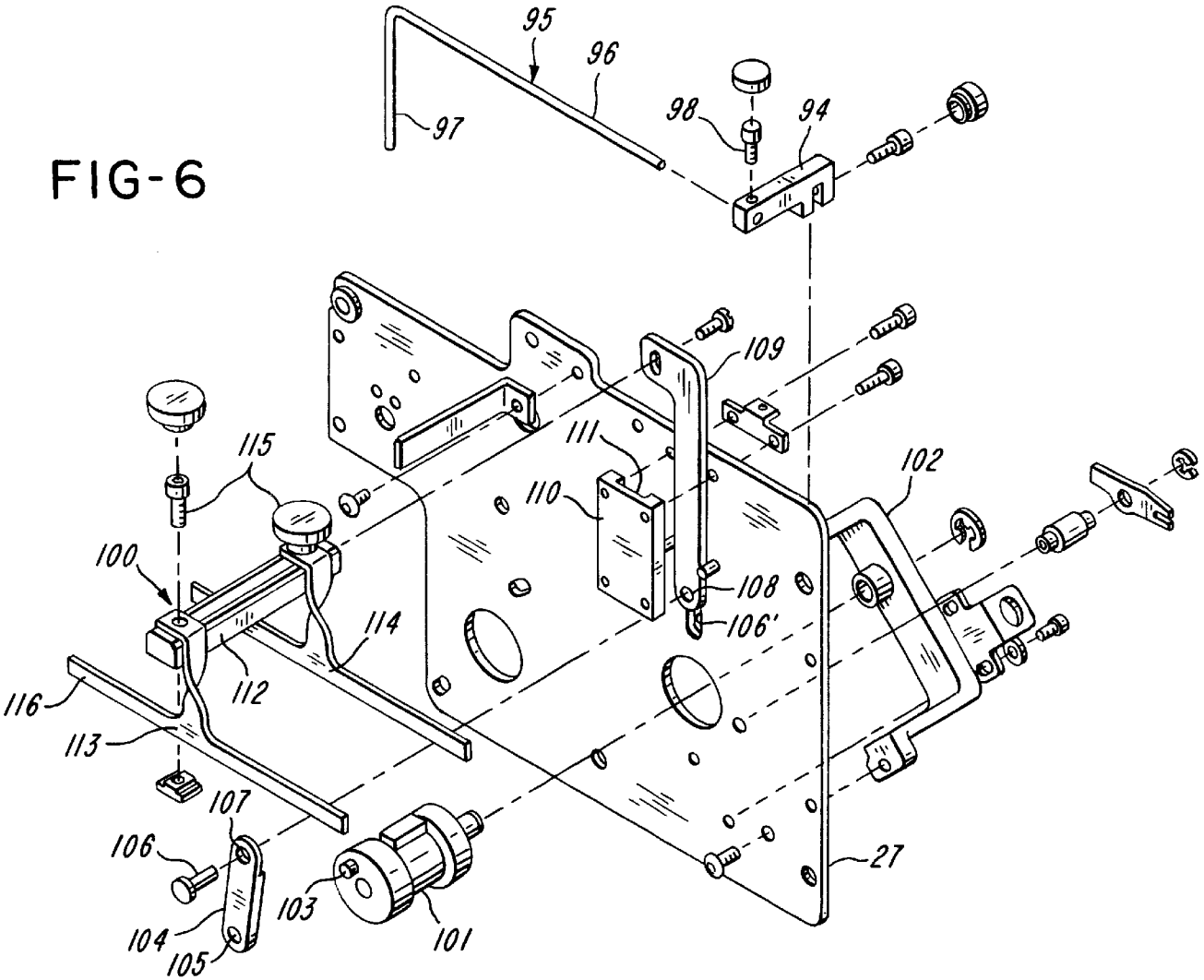
FIG. 6 is a perspective view of a portion of the stacker.

With reference to FIG. 6, a bracket 94 is secured to the plate 27 and mounts a stop generally indicated at 95. The stop 95 has a horizontal portion 96 and a vertical portion 97. As shown in FIG. 5, the vertical portion 97 serves as a stop for the labels L as they are successively advanced into the stacker 73. The stop position of the stop 95 is horizontally adjustable by loosening a screw 98 threadably received in the bracket 94, shifting the stop 95 either forwardly or rearwardly, and re-tightening the screw 98.

The plates 74 and 79 provide a hopper generally indicated at 99 (FIG. 7). The marginal side edges of a pressed looped label L entering the hopper 99 are supported in the channels 77 and 80. In order to strip the newly stacked looped label L from the channels 77 and 80, a tamper 100 (FIG. 6) is provided. The tamper 100 includes a motor-driven single-revolution clutch 101 mounted by a bracket 102. The clutch 101 drives a pin 103 pivotally connected to a link 104 at a hole 105. The link 104 is pivotally connected by a pin 106 received in holes 107 and 108. The hole 108 is in a slide 109 which is guided for straight line movement by a block 110 in a guide slot 111. The upper end of the slide 109 is secured to a transversely extending bar 112. A pair of independently adjustable tamper members 113 and 114 are mounted on the bar 112. Threaded fasteners 115 can hold the tamper members 113 and 114 in any lateral location. This enables of a variety of widths of labels L to be tamped. It is preferred that the horizontal feet 116 of the tamper members 113 and 114 be positioned close to and between the respective channels 77 and 80 to strip the label L therefrom. This will clear the channels 77 and 80 in preparation for receipt of the next pressed looped label L. The tamper 100 also helps to settle the stack S and thus renders it more compact. The tamper 100 is initially in the raised position.

Figure 9:
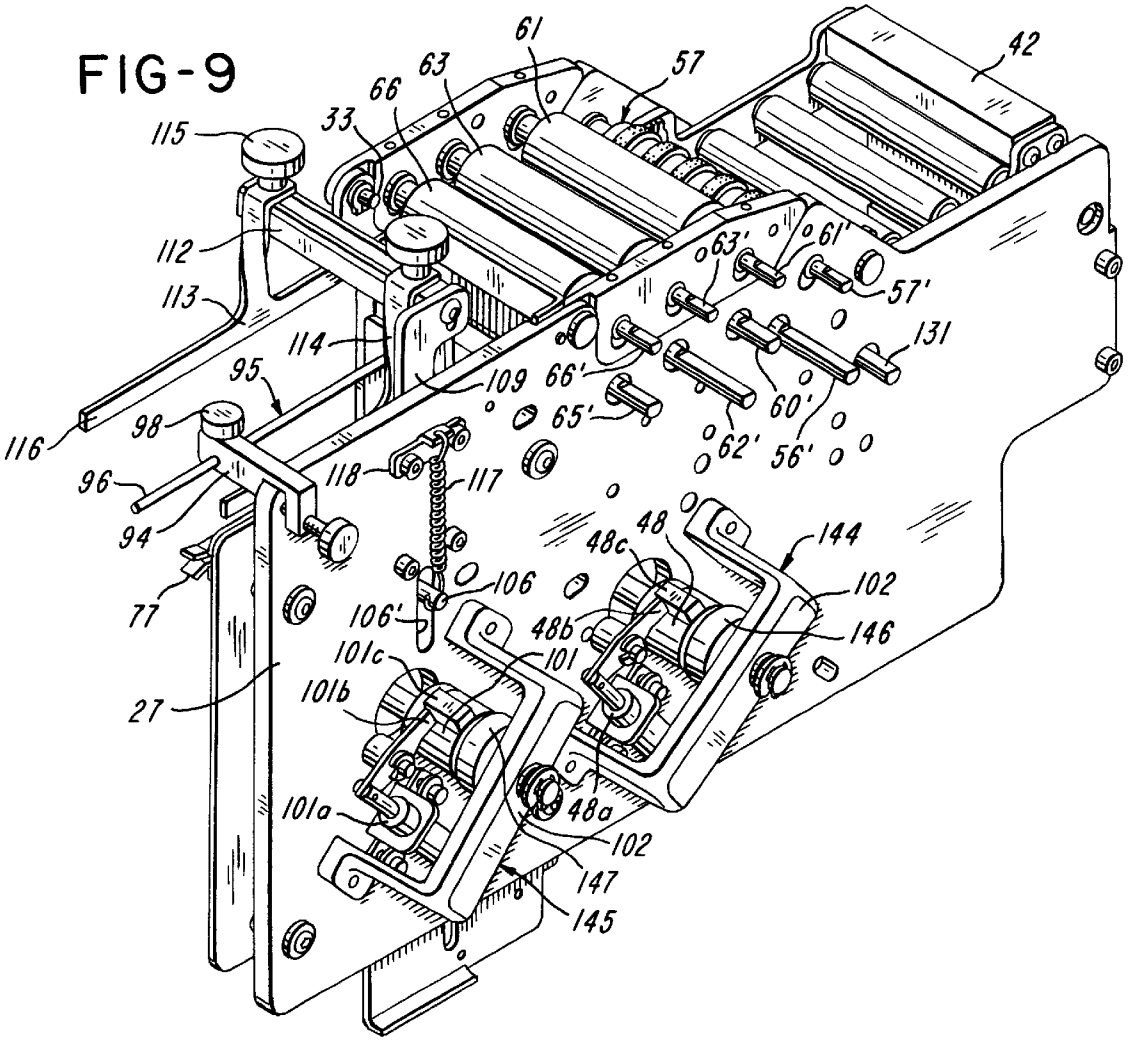
FIG. 9 is a perspective view of the side opposite the looper from the side shown in FIG. 1.

FIG. 9 shows a tension spring 117 connected to a bracket 118 secured to the end plate 27 and to the pin 106 secured to the slide 109. The pin 106 moves freely in a vertical slot 106'. When the rolls 65 and 66 have transferred a pressed looped label L into the channels 77 and 80 of the stacker 73, a solenoid 101' is tripped and the single-revolution clutch 101 is operated to drive the tamper members 113 and 114 downwardly to strip this most recently received label L from the channels 77 and 80. When the single revolution of the pin 103 is nearly complete, the spring 117 helps to return the slide 109 and the tamper members 113 and 114 to their home or raised positions and hold them there.

With continued reference to FIG. 9, the rolls 57, 61, 63 and 66 have respective shafts 57', 61', 63' and 66' to which gears 119, 120, 121 and 122 (FIG. 10) are secured. The gears 119, 120, 121 and 122 in turn mesh with respective gears 123, 124, 125 and 126. The gears 124 and 125 mesh with an idler gear 127 and the gears 125 and 126 mesh with an idler gear 128. The gears 123, 124, 125 and 126 are secured to respective shafts 56', 60', 62' and 65' of respective rolls 56, 60, 62 and 65. The idler gears 127 and 128 are on respective fixed shafts 129 and 130 projecting from the side plate 27.

The shaft 56' also mounts sprockets 131 and 132. The shaft 62' also mounts a sprocket 133. A shaft 134 of a stepper motor 135 mounts a sprocket 136. A timing belt 137 is trained about sprockets 132, 133 and 136. A belt 138 is trained about the pulley wheel 131, a pulley wheel 139 and a pulley wheel 140. The pulley wheel 139 is secured to a shaft 44' for the roll 44. The pulley wheel 140 is rotatably mounted on a shaft 141 on an adjustable bracket 142 of a belt tightener generally indicated at 143. As is apparent, the stepping motor 135 drives the various rolls and the conveyor 29.

As seen in FIG. 9, modules generally indicated at 144 and 145 operate the inserter 47 and the tamper 100, respectively. The modules 144 and 145 are identical. The module 144 includes the single-revolution clutch 48. The clutch 48 is mounted in a U-shaped bracket 102 and has a pulley wheel 146. The clutch 101 of the module 145 has a pulley wheel 147. Solenoids **48*a* and 101*a* are shown in their initial or home positions. When energized the solenoids 48*a* and 101*a* move toothed members 48*b* and 101*b* clear of respective teeth 48*c* and 101*c* to selectively operate the single revolution clutches 48 and 101**.

Figure 10:
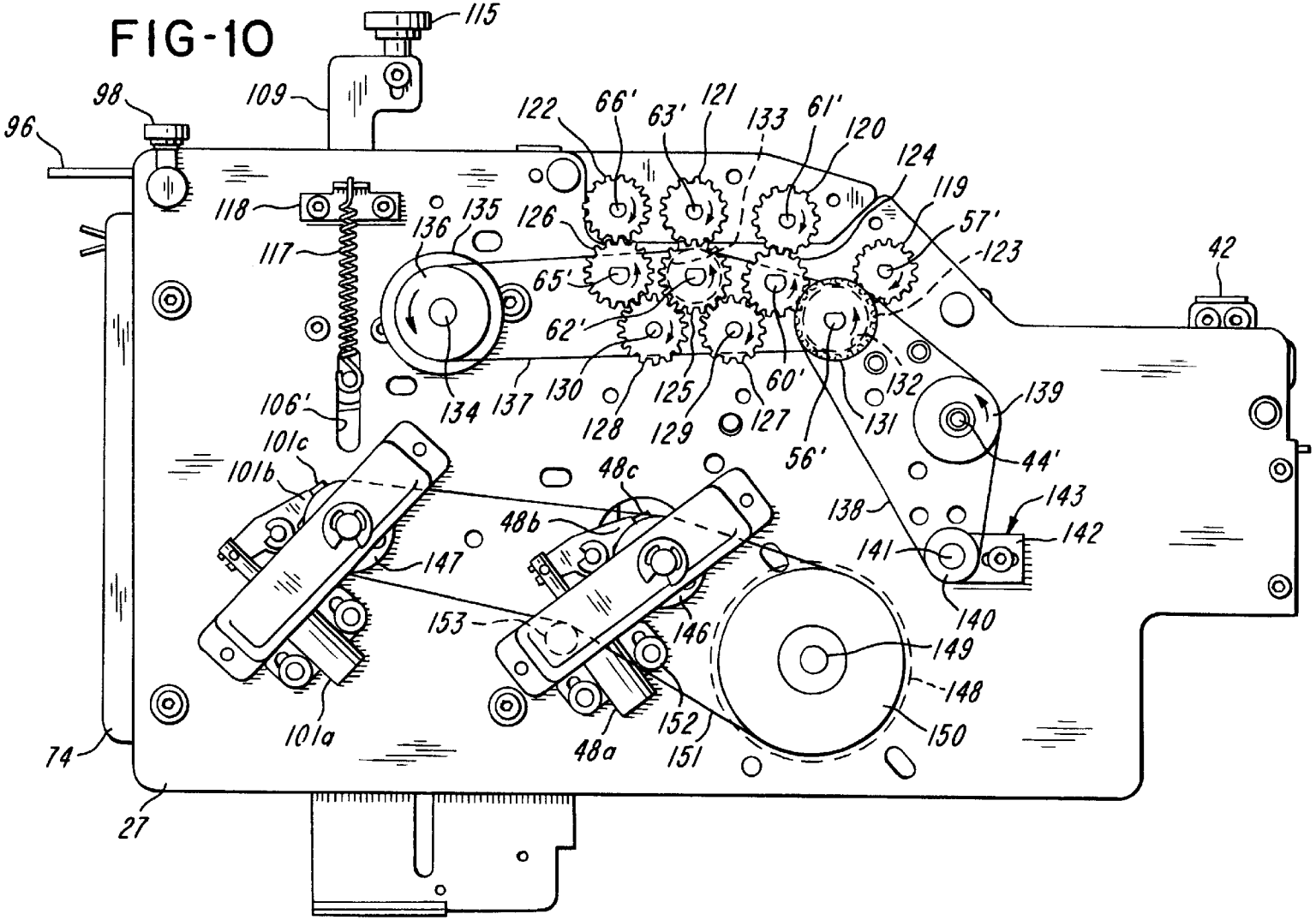
FIG. 10 is a side elevational view of the looper showing in particular the drive mechanism for various components.

With reference to FIG. 10, there is a D.C. electric motor 148 mounted between side plates 26 and 27 with an output shaft 149 projecting through the side plate 27. A pulley wheel 150 is secured to the shaft 149. A belt 151 is trained about the pulley wheels 146, 147 and 150 and passes in contact with idlers 152 and 153. The motor 148 runs continuously and continuously drives the pulley wheels 146 and 147.

Figure 11:
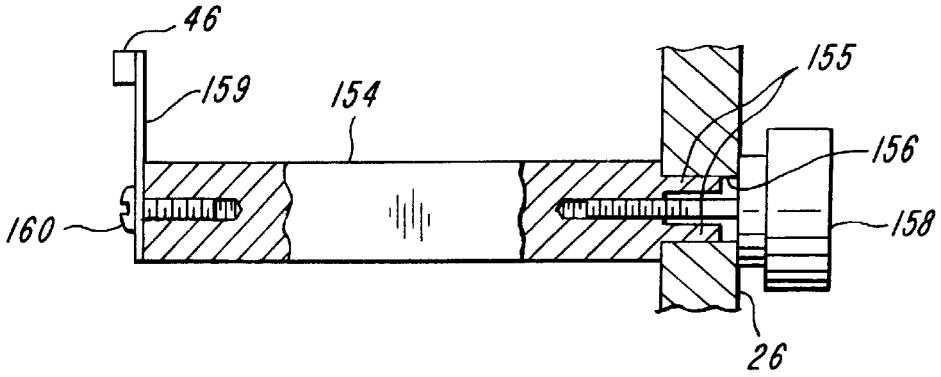
FIG. 11 is a fragmentary elevational view showing the adjustment for one of the sensors.
Figure 12:
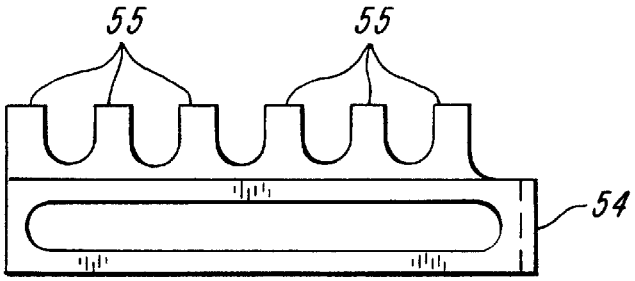
FIG. 12 is an end view of a comb of the inserter.
Figure 13:
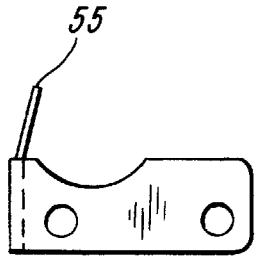
FIG. 13 is an end view of the comb.

With reference to FIG. 11, there is shown an arrangement to adjustably mount the sensor 46. The sensor 46 is mounted on a bar 154. One end of the bar 154 has elongate ears 155 extending into an elongate slot 156 in the side plate 26. The ears 155 extend lengthwise of the slot 156. A screw 157 having a knurled head is threadably received in the bar 154. The ears 155 prevent the bar 154 from rotating but allow the bar 154 to be slid in a direction lengthwise of the slot 156. The sensor 46 is secured to a plate 159 having an elongate vertically extending slot 159' through which a screw 160 passes into the bar 154. FIGS. 14 and 15 best show the cooperation of the tines 55 with the rolls 56 and 57 in both the solid line position and in the phantom line position PL. The label L is not shown in FIGS. 14 and 15 for the sake of clarity.

The stepping motor 135 is under the control of an optical sensor 161 (FIG. 2). When the fold line F operates the optical sensor 161, the microprocessor 200 is notified that the label L will be at the pressing position or station 23 shown in FIG. 4 after a predetermined number of steps of the motor 135. When the folded label L reaches the nip of the rolls 62 and 63, the speed of advance of the label L is reduced or slowed to enable the folded portion L4 to be ironed or pressed for a longer period of time than if the speed of advance were held constant. It is most preferred that when the label L is at the pressing position with portion L4 at the FIG. 4 position, the stepper motor 135 stops so that the label L dwells or stays motionless at the pressing station 23 while the rolls 62 and 63 press the folded label L using heat from the heater 64, and after a predetermined period of time has passed (which is determined as satisfying the proper duration of pressing time) the stepper motor 135 is again started. The stepper motor 135 is again stopped when the next label L reaches the pressing station 23 as depicted in FIG. 4.

A static eliminator 162 is disposed downstream of the roll 66.

Figure 16:
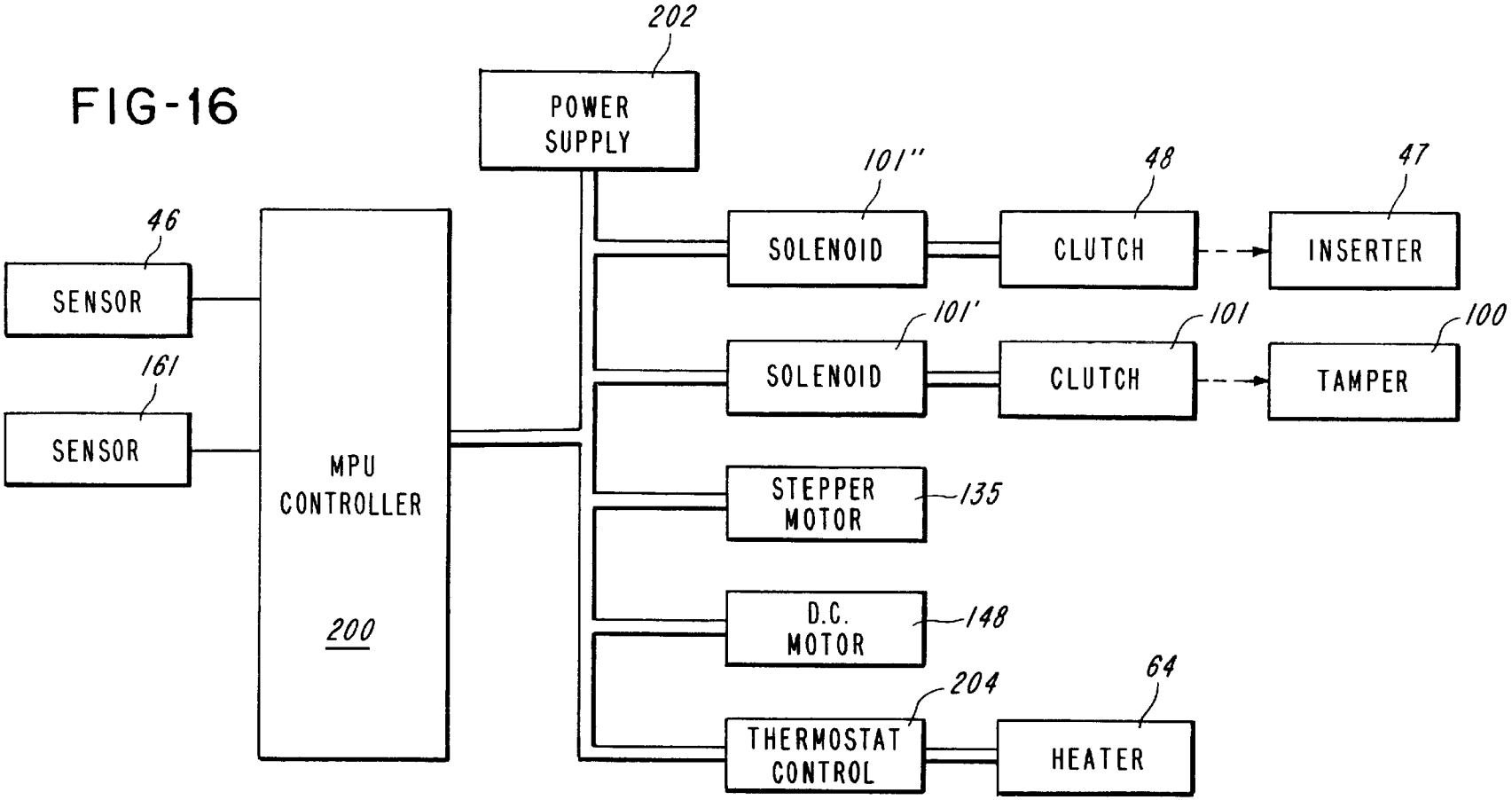
FIG. 16 is a block diagram.

FIG. 16 is a block diagram illustrating the control system of the looper 20. The system includes a microprocessor controller or microprocessor 200 that includes associated memory. The microprocessor 200, as discussed above, is responsive to the output of the sensor 46, indicating the detection of the leading end L1 of a label L to actuate the solenoid operated clutch 48. When actuated, the clutch 48 causes the inserter 47 to move from the position shown in FIG. 2 to the position shown in FIG. 3 to form a fold in the label L. The microprocessor 200 controls the stepping motor 135 to drive the rolls 56 and 57, 60 and 61, and 62 and 63 to advance the folded or looped label to the pressing station 23. When the sensor 161 detects the leading edge of the folded label L, i.e., the fold line F, it outputs a signal to the microprocessor 200. The microprocessor 200 is responsive to the signal from the sensor 161 to stop the motor 135 within a predetermined number of steps from the detection of the fold line F so that the label L is at the pressing position with the fold F between the rollers 62 and 63 as shown in FIG. 4. The heater 64 in the roller 62 is powered by a power supply 202 and controlled by a thermostat control 204 so as to press the fold F into the label L at the pressing station 23. After the time for pressing the label L expires as determined by the microprocessor 200, the microprocessor 200 controls the stepping motor 135 to drive the rolls to advance the folded label L from the pressing station to the stacking station 24. The microprocessor 200 actuates the solenoid operated clutch 101 to in turn actuate the tamper 100. The tamper 100 is actuated a predetermined number of stepper motor steps after the motor 135 is started or resumes its advancing speed to advance the folded label L after the expiration of the dwell time for pressing the label, and this predetermined number of steps is based on the length of time it takes for the stepper motor 135 to advance the longest label into the stacker. This predetermined number of steps may be a fixed number or it may be user selectable, entered by a selector switch, or other input device switch such as a keypad. Whereas the stepper motor 135 is controlled in the most preferred embodiment to start and stop intermittently under the control of the microprocessor 200, the D.C. motor 148 may run continuously when the looper 20 is turned on. The D.C. motor receives power via a transformer or the like of the power supply 202.

Other embodiments and modifications of the invention will suggest themselves to those skilled in the art, and all such of these as come within the spirit of this invention are included within its scope as best defined by the appended claims.

What is claimed is:

1. Method of making a looped label, comprising the steps of: providing an elongate label at a predetermined position, driving the label into the nip of a pair of rotating rolls along a predetermined transverse fold line between opposite ends of the label to provide a looped label, and pressing the looped label using heat and pressure at the fold line to help maintain the looped label in its looped condition.

2. Method as defined in claim 1, further comprising the step of stacking the looped labels in a stack.

3. Method of making a looped label, comprising the steps of: providing an elongate label, folding the label at a predetermined fold line between opposite ends of the label to provide a looped label, advancing the looped label to between a pair of rotatable rolls at a pressing station, wherein at least one of the rolls is a heated roll, stopping the rolls, pressing the looped label at its fold line while the rolls are stationary, and thereafter advancing the label away from the pair of rolls.

4. Method of making a looped label, comprising the steps of: providing an elongate label, tucking an intermediate portion of the label into the nip of a pair of rotating rolls to provide a looped label, pressing the looped label to help retain the looped label in its looped configuration, and stacking the pressed looped label in a stack.

5. Method of making a looped label, comprising the steps of: providing an elongate label, folding the label to provide a looped label, providing a pair of rotatable rolls at least one of which is heated, advancing the looped label at an advancing speed to bring the fold line between the nip of the pair of rotatable rolls at a pressing station, slowing the speed of advance of the looped label to a slowed speed to increase the time the fold line is between the nip of the rolls while the rolls press the looped label, and thereafter resuming the advance of the folded label from out of the nip of the rolls at a speed higher than the slowed speed.

6. Method of making a looped label, comprising the steps of: providing an elongate label, advancing the elongate label to a predetermined position on a table, driving the inserter into contact with the label at a fold line between the ends of the label to fold the label at a fold line and to insert the folded label into the nip of a pair of rotating rolls, advancing the folded label until its fold line is between a pair of pressing rolls, allowing the folded label to be stationary with its fold line in the nip of the rolls for a predetermined period of time, and thereafter advancing the pressed folded label away from the pressing rolls.

7. Method as defined in claim 6, wherein the pressed folded label is advanced into opposed channels in a stacker, and stripping the label from the channels, wherein the stripping is accomplished by tamping action.

8. Method of making a looped label, comprising the steps of: providing an elongate label, folding the label at a predetermined fold line between opposite ends of the label to provide a looped label, advancing the looped label at a predetermined speed to bring the fold line between the nip of a pair of rolls at a pressing station, wherein at least one of the rolls is heated, and decreasing the speed of advance of the looped label while the rolls press the looped label at the fold line.

9. Apparatus for making a looped label, comprising: a conveyor for conveying an elongate label to a predetermined position, a pair of driven feed rolls, an inserter for contacting the label between the ends of the label at a fold line and inserting the label at its fold line into the nip of the feed rolls, a pair of pressing rolls for receiving the looped label from the feed rolls, and at least one of the pressing roll being heated, a heater for at least one of the pressing rolls, the pressing rolls being stationary when pressing the looped label but being rotatable to advance the label, and an electric motor for moving at least one of the pressing rolls to advance the label.

10. Apparatus as defined in claim 9, including a sensor for sensing the leading end of the label, wherein the position of the sensor is adjustable to enable the fold line to be varied.

11. Apparatus as defined in claim 9, including a stacker for accumulating looped labels in a stack.

12. Apparatus as defined in claim 11, including a tamper for tamping a folded label into the stack.

13. Apparatus for making a looped label, comprising: a pair of rotatable feed rolls, wherein at least one of the feed rolls is driven, an inserter for inserting an intermediate portion of the label into the nip of the rotating feed rolls to provide a looped label having a fold line, a pair of pressing rolls disposed downstream of the feed rolls and wherein at least one of the pressing rolls is driven, and a heater for heating at least one of the pressing rolls.

14. Apparatus as defined in claim 13, the pressing rolls being stationary when the label is being pressed at its fold line.

15. Apparatus as defined in claim 13, including a stacker for receiving folded pressed labels from the pressing rolls.

16. Apparatus as defined in claim 13, wherein the feed rolls have peripheral annular ridges and grooves, wherein the ridges of one roll cooperate with the ridges of the other roll, wherein the inserter has tines which can enter the grooves while the label is being inserted into the nip of the feed rolls.

17. Apparatus for making a looped label, comprising: a table, a belt conveyor for conveying an elongate label along a path to a predetermined position on the table, a pair of rotatable feed rolls, an inserter for inserting an intermediate portion of the label into the nip of the rotating feed rolls to provide a looped label having a fold line, a pair of rotatable pressing rolls disposed downstream of the feed rolls, a heater for heating at least one of the pressing rolls, at least one of the pressing rolls being intermittently driven, the pressing rolls being stationary when the label is being pressed at its fold line, a stacker, and an electric motor for driving at least one of the pressing rolls to advance the pressed looped label into the stacker.

18. Apparatus for making a looped label as defined in claim 17, wherein the stacker includes a pair of opposed channels for receiving marginal side edges of the labels, a tamper for stripping the label from the channels, the tamper including a slide, a single-revolution clutch for operating the slide, and at least one tamper foot operated by the slide for stripping the label from the channels.

19. Apparatus for making a looped label, comprising: a pair of rotatable rolls having a nip, means for inserting an intermediate portion of an elongate label at a fold line into the nip of the feed rolls while the feed rolls are rotating, a pair of pressing rolls downstream of the feed rolls for pressing the looped label at its fold line, means downstream of the pressing rolls for stacking pressed looped labels, means for driving the feed rolls and the pressing rolls to advance the looped label, and means for interrupting the driving means to enable the pressing rolls to press the label for a predetermined period of time.

20. Apparatus for making a looped label, comprising: cooperating rotatable pressing rolls having a nip, means for advancing a looped label having a fold line to between the pressing rolls to a position at which the fold line is at the nip, means for heating at least one of the pressing rolls, means for driving at least one of the pressing rolls, and means for interrupting the driving of the pressing roll or rolls to enable the pressing rolls to press the label at its fold line.

21. Apparatus for making a looped label, comprising: a pair of feed rolls having a nip, each feed roll having ridges, the ridges of one feed roll being generally aligned with the ridges of the other feed roll, the ridges of each feed roll being spaced to provide grooves, an inserter cooperable with the label to insert the label into the nip of the feed rolls, and the inserter including tines movable into and out of the grooves of at least one of the feed rolls.

22. Apparatus as defined in claim 21, including means for pressing the looped label.

23. Apparatus as defined in claim 21, including means for stacking the looped label.

24. Method of making a looped label, comprising the steps of: providing an elongate label, capturing and moving the elongate label by using a conveyor to move the label to a predetermined position, driving the label toward the nip of a pair of rotating rolls along a predetermined fold line between opposite ends of the label while a trailing marginal end portion of the label is still captive by the conveyor to provide a looped label, and the step of heating and pressing the looped label at the fold line to help maintain the looped label in its looped condition.

* * * * *

UNITED STATES PATENT AND TRADEMARK OFFICE

CERTIFICATE OF CORRECTION

PATENT NO. : 6,419,616 B1
DATED : July 16, 2002
INVENTOR(S) : Donald A. Campbell It is certified that error appears in the above-identified patent and that said Letters Patent is hereby corrected as shown below:

Column 8,
Line 7, "the" should be -- an --.
Line 13, after "the" insert -- pressing --.

Signed and Sealed this

Twenty-fifth Day of March, 2003

JAMES E. ROGAN
*Director of the United States Patent and Trademark Office*